US007553223B1

(12) United States Patent
Ristvedt et al.

(10) Patent No.: US 7,553,223 B1
(45) Date of Patent: Jun. 30, 2009

(54) COIN SORTER WITH EXTERNAL STRIP SEPARATOR

(75) Inventors: Victor G. Ristvedt, Manchester, TN (US); Mark E. Ristvedt, Oak Ridge, TN (US)

(73) Assignee: Ristvedt, LLC, Lavergne, TN (US)

( * ) Notice: Subject to any disclaimer, the term of this patent is extended or adjusted under 35 U.S.C. 154(b) by 779 days.

(21) Appl. No.: 10/858,255

(22) Filed: Jun. 1, 2004

(51) Int. Cl.
*G07D 3/00* (2006.01)

(52) U.S. Cl. ..... 453/12; 453/49; 453/57

(58) Field of Classification Search ..... 453/3, 453/6, 10, 12, 14, 15, 49, 57, 33, 34; 232/60
See application file for complete search history.

(56) References Cited

U.S. PATENT DOCUMENTS 1,260,802 A * 3/1918 Purt ..... 453/14
3,173,431 A * 3/1965 Chichester et al. ..... 453/12
3,422,824 A * 1/1969 Persson ..... 453/8
4,607,649 A 8/1986 Taipale
5,022,889 A * 6/1991 Ristvedt et al. ..... 453/6
5,382,191 A * 1/1995 Rasmussen ..... 453/11
5,468,182 A * 11/1995 Geib ..... 453/10
5,489,237 A * 2/1996 Geib et al. ..... 453/12
6,171,182 B1 * 1/2001 Geib et al. ..... 453/10
2003/0100255 A1 * 5/2003 Allison ..... 453/14
2004/0188222 A1 * 9/2004 Bolen ..... 194/337
2008/0139098 A1 * 6/2008 Azzurri ..... 453/5

* cited by examiner

*Primary Examiner*—Patrick H Mackey
*Assistant Examiner*—Jeremy Severson
(74) *Attorney, Agent, or Firm*—David E. Mixon; Frank M. Caprio; Bradley Arant Boult Cummings LLP

(57) ABSTRACT

A coin sorter has a separator strip disposed outside of an exit area of a stationary plate in which a line of coins of mixed denominations are indexed against a spirally extending ridge in a single layer and single file. The strip has a series of incremental segments defined in a side facing the center of a resilient disc which enables the coins to be captured. An edge area of the strip is configured to immediately re-capture coins as they are released at the exit area and to hold the coins until they pass by a segment of the strip that is far enough away from the indexing line of the coins that they are no longer captured, but are freely released. The released coins then proceed outward along a specific path defined for a particular coin denomination.

8 Claims, 6 Drawing Sheets

COIN SORTER WITH EXTERNAL STRIP SEPARATOR

FIELD OF THE INVENTION

This invention relates to high-speed coin sorting machines of the type that generally use a rotating resilient disc in combination with a stationary head or guide plate, and particularly to such a machine whereby the guide plate merely aligns the coins in a single file, with the coins being sorted after they exit from under the guide plate.

BACKGROUND OF THE INVENTION

Numerous patents have disclosed coin sorters which employ annular sorting heads located over and closely adjacent to a rotating resilient disc. Typically coins are introduced through a central opening in a metal sorting head. One of the functions of undersides of sorting heads are designed to produce a single layer and single file of coins, a condition required for sorting. Prior sorting devices are also generally characterized in that sorting is performed under the head, most using numerous lands and grooves that makes initial manufacturing costs as well as maintenance costs expensive, as the sorting head must be replaced when it wears to a point where it will no longer accurately sort coins. Accordingly, it is desired to provide a coin sorter in which the sorting function is largely removed from underneath the head to an outside location, using an inexpensive separating mechanism. This approach would enable use of a simpler, less expensive head that only performs the functions of aligning and directing the coins to obtain an indexed line of coins in a single file single layer configuration.

SUMMARY OF THE INVENTION

The present invention is directed to a coin sorter in which sorting is carried out by use of a separator strip installed outside of an exit area for coins in a line indexed to an inner land or ridge underneath a feeder head, the coins having been arranged into a single layer and single file under the head by a spiral track. The exit area from the feeder head may take the form of a transverse cut into the spiral track, the track at this point having an end generally disposed radially with respect to the head. Captured coins in the track approaching this exit area are held in place in the track between the rotating pad and the stationary head. Unlike most coin sorter heads, which index the coins outwardly to a wall in the sorter head, aligned coins in the present apparatus are indexed inwardly.

The separating and sorting strip is located at the end of the track and outside the head, and constructed to provide a series of precise, exclusive paths, one path for each denomination of coins. Provision of these paths results from structure and placement of the strip. The strip may be generally rectangular, with a first end adjacent said exit area, and which may be inserted in a notch defined in an outer and lower corner of the exit area. An inner side of the strip is provided with a series of incremental, slightly concave steps or segments, preferably arcuate in shape, each succeeding step or segment being defined by a longer radial distance from a center of the pad.

It is accordingly an object of this invention to provide a coin sorter having a sorting mechanism outside of the head, which is only used for aligning and presenting a line of mixed coins for sorting.

Another object is to provide a a coin sorter characterized by decreased costs of manufacture and maintenance.

Still another object is to provide a coin sorter readily convertable from use on one coinage system to use on another.

DETAILED DESCRIPTION OF THE DRAWINGS

Figure 1:
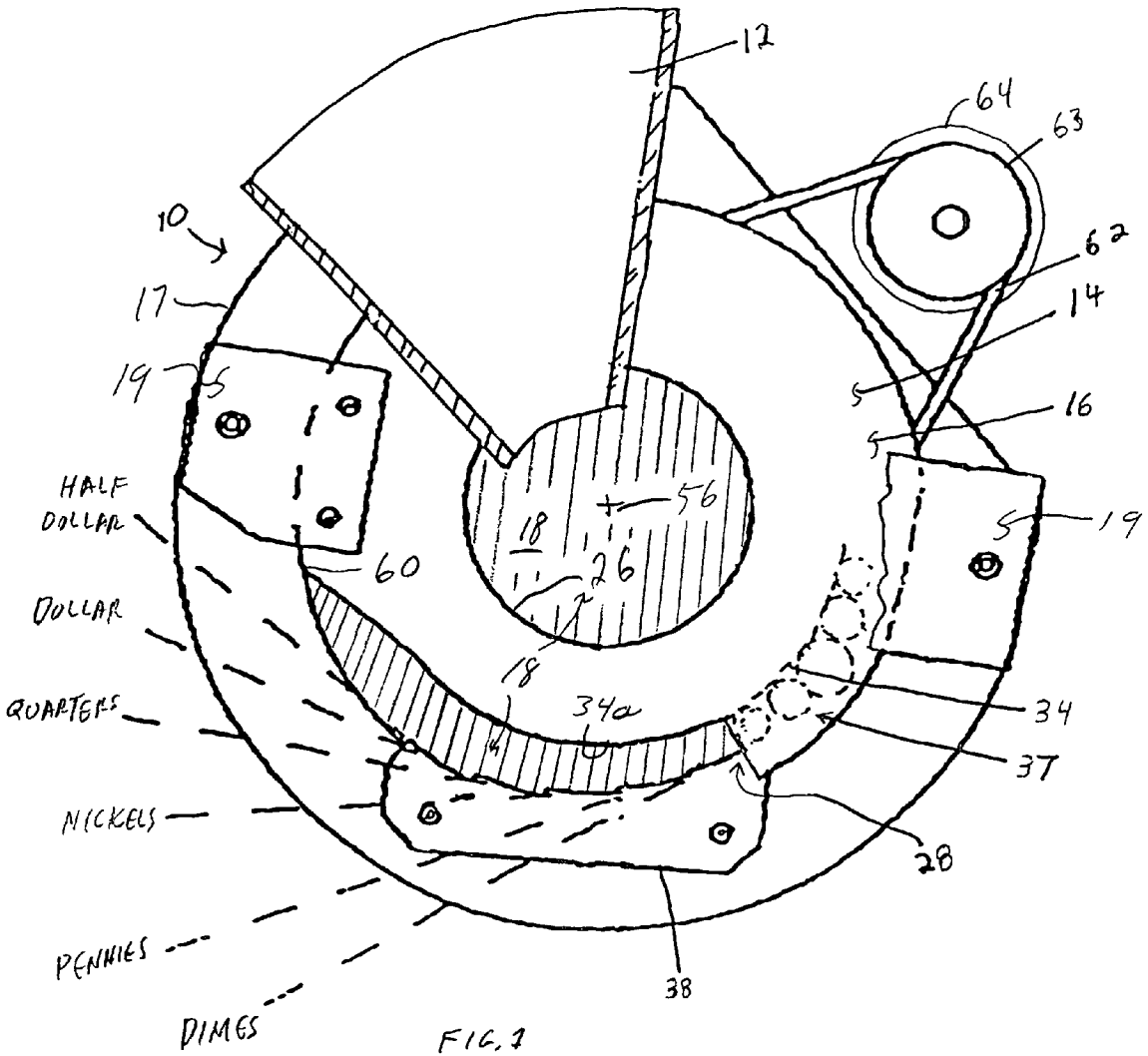
FIG. 1 is a view from above of a coin sorter showing a separating strip mounted in position adjacent a feeder head and depicting the directions which each denomination of coins follows when ejected outward.

Referring to FIG. 1 there is shown a top view of a coin sorter 10 with a coin-receiving hopper 12 shown broken away, the sorter including a feeder head 14 comprising a stationary plate 16, with a rotating disc or pad 18 (shown shaded for clarity) of resilient material closely positioned underneath plate 16. Plate 16 is shown mounted to a base 17 in which a platter rotatably supporting pad 18 is mounted, plate 16 being mounted in elevated relation over pad 18, by way of example using standoffs (not shown) and plates 19 (on the right shown partially cut away) In other mounting configurations, a hinge on one side may affix the plate to base 17, with a locking member provided on the other side of plate 16 for hingably locking the plate to the base. Any conventional way of mounting plate 16 over pad 18 may be used, although a typical configuration is to use a three point mount that is adjustable so as to accommodate minor variations in thicknesses of the pad, which must be changed when worn, such mounting configurations being well known to those skilled in the art.

A generally spiral track 20 (FIG. 4) and shown unshaded, is cut into an underside of plate 16. Track 20, in a direction of coin flow, begins at a point 24 within a generally central opening 26 in plate 16 and spirals around the underside of plate 16 to an exit point 28 from which coins exit from underneath plate 16. Plate 16 has a central opening 26 into which hopper 12 is placed so that a supply of coins may be introduced through opening 26 and deposited onto pad 18.

Track 20 has multiple levels wherein coins are captured between an upper surface of the track and pad 18 to lessor or greater degrees, as will be further explained. Also, mechanisms are provided in track 20 to separate coins that initially are stacked one on top of another, also as will be explained. Coins moving in track 20 from opening 26 are aligned and forced into a single file initially under the influence of centrifugal force against a bevelled inner edge 30 of an outer ridge or land portion 32, which also begins at point 33, the coins thereafter thereafter captured by the resilient pad and rotated concentrically until they are abutted against an outwardly spiraling edge 34 (FIG. 4 and a partially dashed line in FIG. 1) of land portion 36 along which the coins are indexed. Edge 34 of land portion 36 transitions at about point 58 to edge 34*a*, which is approximately concentric from center 56 of the pad at least along the region adjacent segments or steps 54*a*-54*e*. While the outward spiral of edge 34 is pronounced so as to index all coins against 34, edge 34*a* may be generally concentric with respect to the center 56 of the pad, or have a very slight outward spiral to maintain an inner edge of coins against edge 34*a*.

A line of so-indexed coins 37, also shown by dashed lines, are rotated between plate 16 and resilient disc 18 toward exit area 28 at the outer end of track 20 where all of the coins are released from underneath plate 16. Here, a coin sorting and separating strip 38 exterior of plate 16 intercepts coins from exit area 28 and maintains a captured state of an outboard region of the coins until they are released (except dimes) as will be further explained.

Separating strip 38 may also be mounted on base 17 (FIG. 2), as by two posts 42, 44, and may be secured by fasteners, such as screws 46, 48. Alternately, strip 38 may be mounted to plate 16, or the equivalent of a strip 38 may be fabricated integrally with plate 16, although this would defeat a significant feature of the invention, i.e. changing strip 38 in order to configure sorter 10 for different coinage systems of coins for different countries. Typically, strip 38 would be adjustably mounted in a similar manner as plate 16 in order to accommodate minor variations of thickness of replacement pads. With this construction, strip 38, an inexpensive component, may easily be changed when worn, instead of having to change the entire plate 16 as is required with other coin sorters of the prior art. Thus, the coin sorter of the instant invention is inexpensive to maintain, as strip 38 is the primary part that wears. In addition, and as stated, strip 38 may be changed to accommodate coinage of different countries. In this instance, a single design of machine may be used to construct sorting machines for many different countries simply by changing strip 38 to a strip that has a number of steps 54 corresponding to the number of coins for that country, and which have distances from edge 34*a* corresponding to respective diameters (denominations) of coins for that country.

A corner area 50 of the strip may be located within a notch 52 (FIGS. 4 and 8) at an outer corner of a lower side of exit area 28. Strip 38 is mounted so as to generally conform to the same level as the underside surface (track 20) of the adjacent exit area 28 of plate 16 so as to smoothly receive coins exiting from exit area 28. In some instances, a region of strip 38 immediately adjacent to exit area 28 may be bent slightly upward and away from disc 18, for instance to an extent of 0.020 to 0.030 inch over a distance of about 0.300 inch, with the highest point being in notch 52 and thereafter descending with the flow of coins so that coins are fully captured along their outboard sides as they exit from underneath plate 16. This feature allows for a smooth capture of coins exiting from exit area 28 by strip 38.

Figure 2:
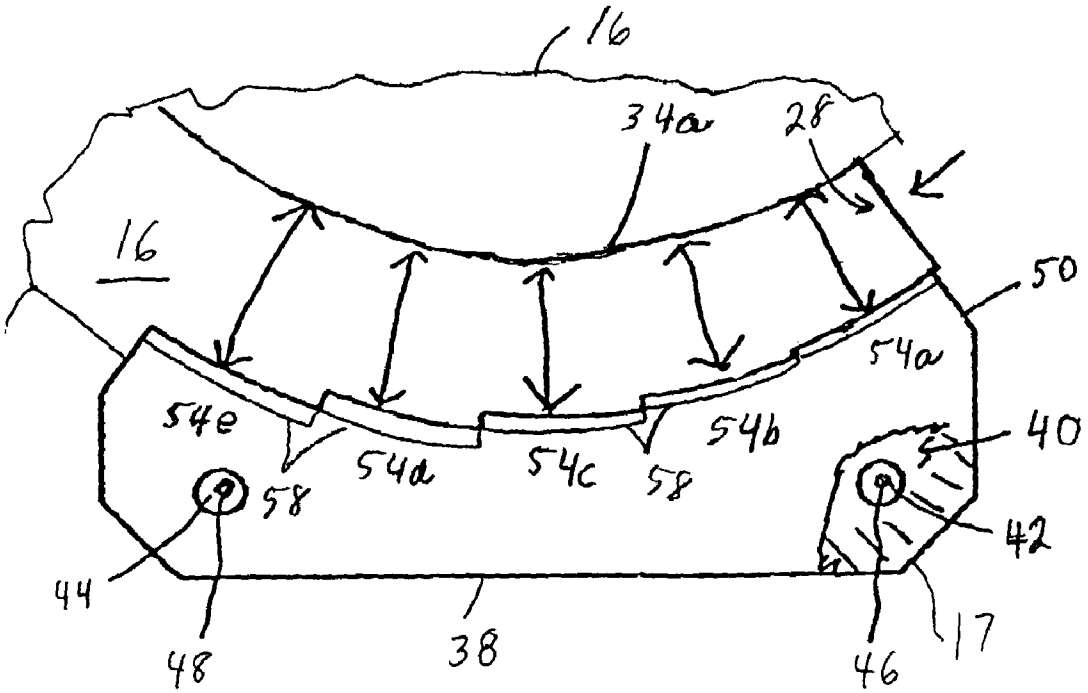
FIG. 2 is an enlarged view taken from above of a separating strip.
Figure 3:
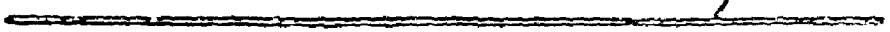
FIG. 3 is a side view of the separating strip.

Referring to FIG. 2, the strip 38 is configured such that any coin of a larger diameter than the space between the outer edge of the coin and edge 34*a* (illustrated by arrows) of plate 16 will be restrained from being released because an outboard portion of the restrained coin is captured underneath a respective edge portion of the strip. Steps or segments 54*a* through 54*e* (for United States coinage) of strip 38 are located at increasing radial distances from edge 34*a*, which is opposite strip 38 and as shown in FIG. 4 is configured as being generally concentric with respect to a center of rotation 56 of pad 16, as opposed to the pronounced outward indexing spiral of edge 34 under plate 16 and within track 20.

The distances between any step of steps 54*a*-54*e* and edge 34*a* are slightly greater than respective U.S. coin dimensions from the penny, nickel, quarter, dollar and half-dollar in order of smallest to the largest. The smallest coin, in U.S. coinage dimes, are not captured at all by a step in strip 38, but are simply released at release area 28 and take a slightly elevated trajectory, as will be explained, from release area 28 as indicated by the dashed line designated DIMES in FIG. 1. Alternately, a step may be provided for the smallest coin. Significantly, a bevel 58 at about a 45 degree angle toward pad 16 may be provided on an edge of each of steps 54*a*-54*e* so that coins released at any particular step do not encounter an edge at that step or following steps. With respect to coins other than dimes, as discrete coins are moved by pad or disc 16 under strip 38, capturing these coins along their outboard sides under the strip, any particular coin will reach a step or segment in the strip where the distance between a respective step and edge 34*a* is greater than a diameter of that denomination of coin, causing the outboard side of the coin to be released from capture by the strip at that step, resulting in release of the coin. When the coin is released, it follows a specific, unique trajectory or path with respect to other denominations of coins as it moves tangentially away from pad 16 and edge 34*a*. As shown in FIG. 1, release points and paths for the different denominations of coin are shown, as determined for U.S. coinage, with these release points and paths located further downstream as coin size increases. An elongated, cut-away region in plate 16 extending from release area 28 to a point 60 downstream exit area 28 allows the released denominations of coins to follow their respective paths. The differences in trajectories of the released coins are large and precise so that recovery of the coins with suitably placed receptacle openings each leading to a respective catching bag or other receptacles is easily facilitated.

Disk 18 may be mounted to a flat metal or hard plastic platter sized to receive resilient disc 18, the platter rotatably supported by anti-friction bearings or bushings in base 17, and connected to a pulley (not shown) mounted below the platter. This pulley may be connected, as by a drive belt 62 (FIG. 1) to a second pulley 63 in turn connected to a drive shaft of an electric motor 64. Alternately, the platter may be manually turned by a crank and gear assembly, or by other means, such as a gear assembly coupled between motor 64 and the platter, or a frictional roller arrangement between the platter and motor.

Figure 4:
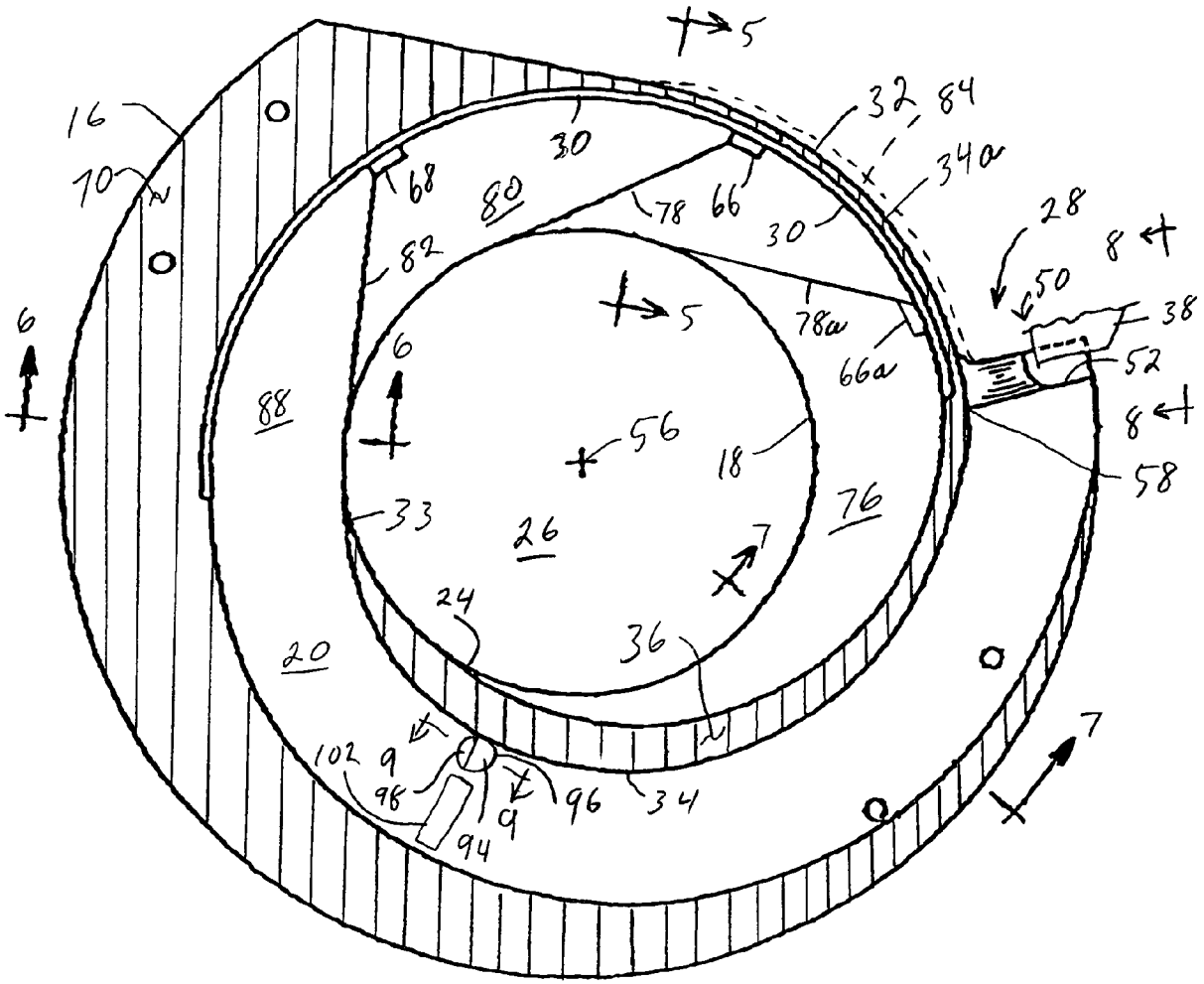
FIG. 4 is a view of a feeder head taken from below.

As shown in FIG. 4, the underside of stationary plate 16 adjacent disc 18 is divided by lands that define track 20, which may have, in some embodiments, three (or in some embodiments four) different surface regions of different distances from disc 18. These lands are shaded for clarity in FIG. 4, with the surface of these lands extending downward to about 0.005 inches or so from pad or disc 18. The different recessed unshaded surface regions between the lands perform various functions in contributing to obtaining an indexed line of coins in single file and a single layer, which configuration being necessary to enable sorting. Other features contributing to these functions include ramps 66 and 68 located at an outer edge 30 of track 20 between two of the regions, and the downwardly extending land portion 36 disposed in an outward spiral forming indexing edge 34 against which coins are indexed, to about point 58 where the edge transitions to a generally concentric 34*a* with respect to a center of rotation 56 of the pad.

As stated, the shaded area of outer region or land portion 70 and its continuation via land or ridge portion 32 to a more central spiral land portion 36 has a distance from pad 18 of about 0.005 inches or so. This means that there is practically no clearance between the lower surface of land portion 70, land portion 32 and spiral land portion 36 and the surface of disc 18, and any clearance therebetween will be only a small fraction of the thickness of the thinnest coin. This distance ensures that these thinnest coins are constrained within track 20 and prevented from moving under land portion 70, land portion 32 and spiral land portion 34.

Referring to FIG. 4, coins initially move from the hopper through opening 26 and underneath plate 16 into a collection region 76 where the upper surface of region 76 is recessed about 0.086 inches from the shaded bottom surfaces of land portions 70, 32 and 34. This distance is selected to be greater than the thickness of the largest coin, and for United States coinage, is about 0.086 inches or so. If necessary, the various recessed regions in plate 16 may be constructed having differently dimensioned regions, although this is not anticipated. Within collection region 76 coins fed into the sorter via hopper 12 are free to move outward by centrifugal force until they are restrained in their outward movement by inner edge 30 of land portion 32 and inner edge of land portion 36. As a result of the distance between the upper surface of collection region 76 and the pad, thinner coins may become layered in collection region 76. Most of such layered coins are separated by ramp 66 and a transition edge 78 that transitions to an intermediate region 80 wherein the upper surface of this region is recessed about 0.054 inches from bottom surfaces of land portions 70, 32 and 34. Here, thicker coins are captured between surface 80 and pad 18, pressing these thicker coins into the pad and causing them to rotate concentrically with respect to center of rotation 56 of pad 18. As shown, transition edge 78 is angled back toward central opening 26 of plate 16 so that coins that are not against inner side 30 of land portion 32 as they are rotated by pad 18 do not encounter ramp 66, and are simply directed back to opening 26 of plate 16 by transition edge 78. Those coins that are riding against the inner side 30 encounter ramp 66, pressed further into the pad and are rotated into intermediate region 80. Stacked coins that are riding against edge 30 as they encounter ramp 66 are separated by virtue of the lower coin against the pad being positively rotated by the pad while the upper coin, in being pressed against the ramp, is dragged off the lower coin by the ramp as the lower coin is rotated past the ramp and into intermediate region 80. Here, coins (except dimes) are at least partially captured and rotated circumferentially in track 20 by pad 18. Dimes are still generally free to move within intermediate region 80. A second ramp 68 and second transition edge 82 are located between intermediate region 80 and a final capture region forming track 20. As shown, second transition edge 82, like transition edge 78, functions to direct coins not against edge 30 back to opening 26 of plate 16. Ramp 68 functions as described for ramp 66 so that an upper one of stacked coins encountering ramp 68 is retarded while the lower coin of stacked coins is moved ahead into track 20. Edge of 30 is bevelled as shown at about a 45 degree angle to prevent bouncing of coins against edge 30.

While 2 ramps 66 and 68 and associated transition edges 78 and 82 are shown, a third ramp 66*a* and associated transition edge 78*a* may also be provided, this latter edge and ramp providing more opportunity for coins to initially be urged against edge 30 and to be separated from a stacked state. In this instance, the first region downstream transition edge 78*a* is recessed 0.010 inches less than collection area 76. Thus, this region is 0.076 inches above the bottom surface of land 32. Here, this thin transition edge 78*a* is believed to separate three stacked thin coins and two stacked thicker coins prior to the coins entering intermediate region 80.

As the coins enter track 20, which may be recessed about 0.025 inches from bottom surfaces of land portions 70, 32 and 34, all coins are in a single file and fully captured and rotated concentrically with respect to a center of rotation 56 of pad 18. During this concentric rotation, inboard edges of the coins eventually are abutted against edge 34 of spiral land portion 36 where the coins are forced to take an outward spiral path defined by edge 34, which also moves the coins radially outward on pad 18. As such, the coins are indexed along their inboard edges against edge 34 of spiral land portion 36.

Figure 7:
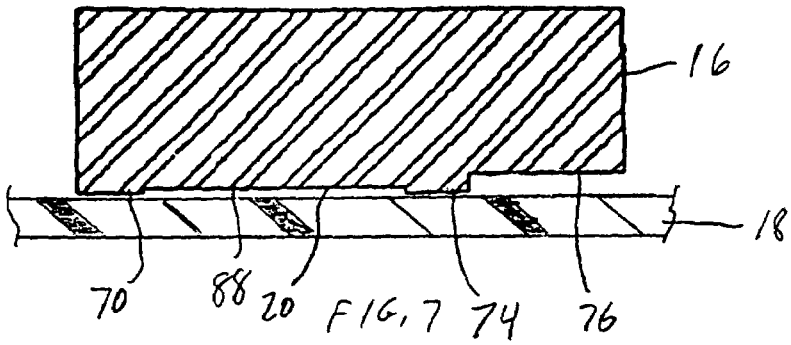
FIG. 7 is a sectional view taken along line 7-7 of FIG. 4.
Figure 5:
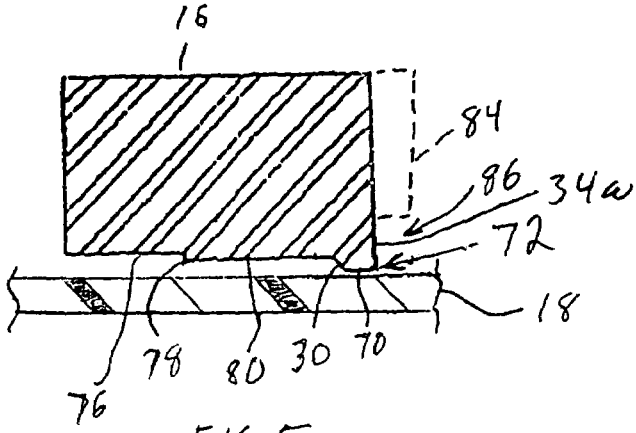
FIG. 5 is a sectional view taken along line 5-5 of FIG. 4.
Figure 6:
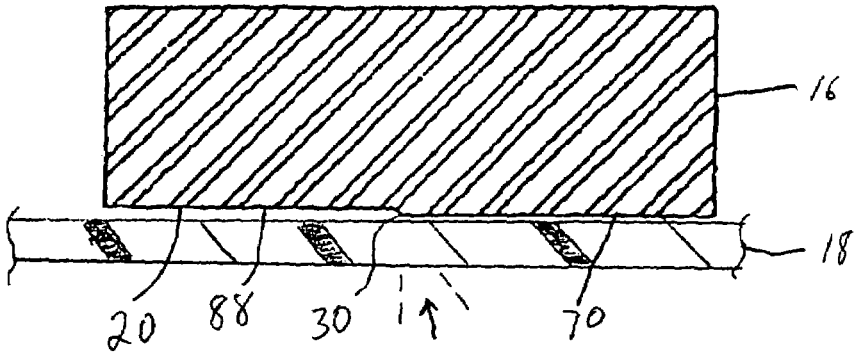
FIG. 6 is a sectional view taken along line 6-6 of FIG. 4.

FIGS. 5, 6, and 7 show relative thicknesses of the feeder head plate and surface features of the bottom surface. The plate 16 in each drawing may have a beginning thickness of about 0.85 inch, although thicker or thinner plates could be used. The first sectional view, FIG. 5, shows thicknesses of collection region 76 and intermediate region 80 with respect to the bottom surface of land 70, this bottom surface extending as shown as the shaded areas of FIG. 4 into all the land portions 70, 32 and 34. Also as stated, this bottom surface is spaced a very small distance (shown exaggerated for clarity) from pad 18, typically about 0.005 inches or so for US coinage. As shown in FIG. 5, collection region 76 is recessed about 0.086 inches from the bottom surface, while intermediate region 80 is recessed about 0.054 from the bottom surface. As described supra, the recess dimension of collection region 76 is such that none of the coins are captured, allowing them to freely move outward by centrifugal force developed by rotation of the coins on the pad until they are generally restrained by bevelled edge 30 of land portion 32. Any coins that are not against edge 30 are rotated against transition edge 78 and moved along this edge back to the open center 26 of plate 16. Coins that are against edge 30 are rotated to move downward across ramp 66 into intermediate region 80 (FIG. 4). As described, most coins in stacked relation are separated as they move across ramp 66. In addition, plate 16 may be provided with an extended region 84 (dashed lines in FIGS. 4 and 5) forming a notch or ridge 86 along and outboard portion of plate 16 opposed from strip 38 and above edge 34*a*. Here, notch or ridge 86 would serve to loosely constrain an inboard region of coins to limit an upward extent of movement of the inboard region of coins. This upward movement arises from the fact that the outboard edge of coins are captured under strip 38, in some instances by only a small fraction of the diameter of the coin, and pressed at this outboard region into the pad by, in the case of dimes, about 0.020 inches or so. Due to the resilient nature of the pad, this naturally causes the inboard region of the coin to tip upward. Here, the thicker the coin the more upward tipping is evident. For some national denominations of coins other than United States coins, this upward tipping may need to be limited, as by ridge or notch 86, in order to effect proper sorting. Ridge or notch 86 may be constructed so that it is an integral part of plate 16, or constructed as a separate component, such as an arcuate strip of material, that is attachable as by fasteners, to the side of plate 16 opposed from strip 38. Also, where necessary, ridge or notch 86 may be constructed so as to be of varied radial dimension to accommodate tipping of thicker or thinner coins, or vary in vertical dimension to vary a limit of tipping of these coins. It is emphasized that ridge or notch 86 is not intended to capture coins against pad 18 but merely limits extent of upward tipping of coins in coinage systems of other nationalities where necessary. It has been found that this feature is not necessary with respect to United States coins.

FIG. 6 shows thicknesses of final capture region 88 in track 20 and the outboard bottom surface of land portion 70. Here, as stated, final capture region 88 is recessed about 0.025 inches with respect to the bottom surface so that all coins are captured between surface 88 and pad 18. As shown in FIG. 4, a second ramp 68 and transition edge 82 serve to separate any coins that are stacked, and move any coins not against edge 30 back to a center of plate 16 where they have another chance to be moved as described against edge 30 by centrifugal force.

The sectional view of FIG. 7 shows thicknesses of outer land portion 70 and inner land portion 36, the recess therebetween defining track 20. In addition, a portion of collection region 76 is shown. As stated, track 20 is recessed about 0.025 inches from a bottom surface of land portions 70 and 36, with collection region 76 recessed about 0.086 inches from surfaces of the bottom of these lands.

Figure 8:
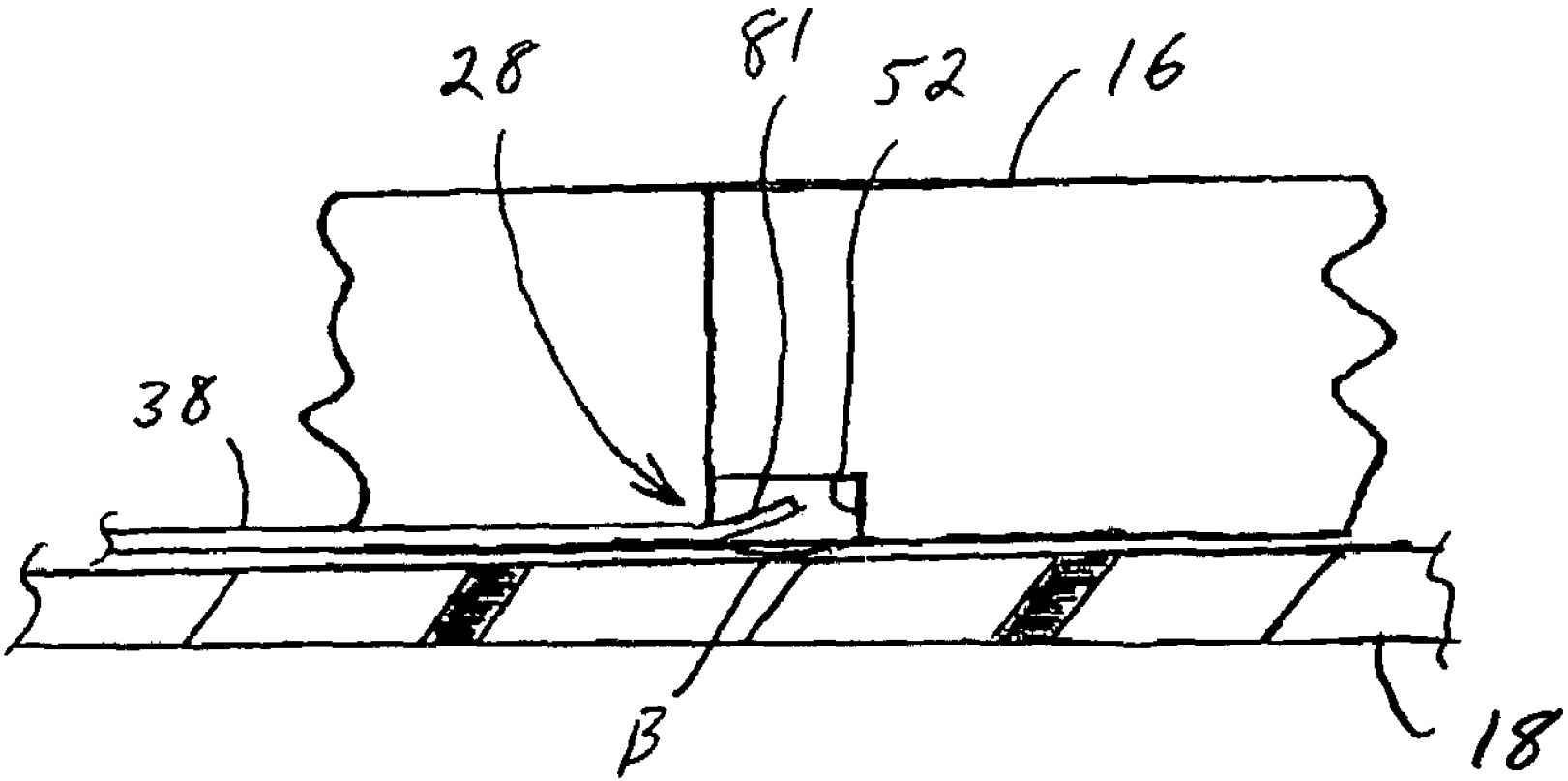
FIG. 8 is a side view of the feeder head showing details of construction thereof.

FIG. 8, a side elevational view of the region around exit point 28 shows pad 18 hatched for clarity, although the pad is not sectioned in this view. This view shows notch 52 within which strip 38 is fitted, the mounting arrangement of strip 38 also not shown for clarity. Also shown is the bend 81 at the end of strip 38 (shown exaggerated for clarity) that is fitted into notch 52. As earlier stated, this bend 81 allows a smooth transition of coins exiting in a captured state across their full width from track 20 from under exit point 28 to being in a captured state along their outboard sides by strip 38. In addition, another feature is shown in FIG. 8 that assists in sorting of small thin coins, such as dimes. Here, the region of track 20 adjacent notch 52 is constructed having a downwardly extending bump B extending across the width of the remainder of track 20 not occupied by notch 52, as indicated by shading in FIG. 4. This bump B extends downward about 0.002 to about 0.004 inches or so toward pad 18, and may in some instances barely touch the pad. Bump B serves to cause the smallest and thinnest coins, such as dimes, to be tipped upward slightly as they exit from underneath track 20 so that they will clear strip 38 by a small elevation in their trajectory as shown in FIG. 1. Where a step in strip 38 is provided for the smallest diameter coin, bump B may not be needed.

Figure 9:
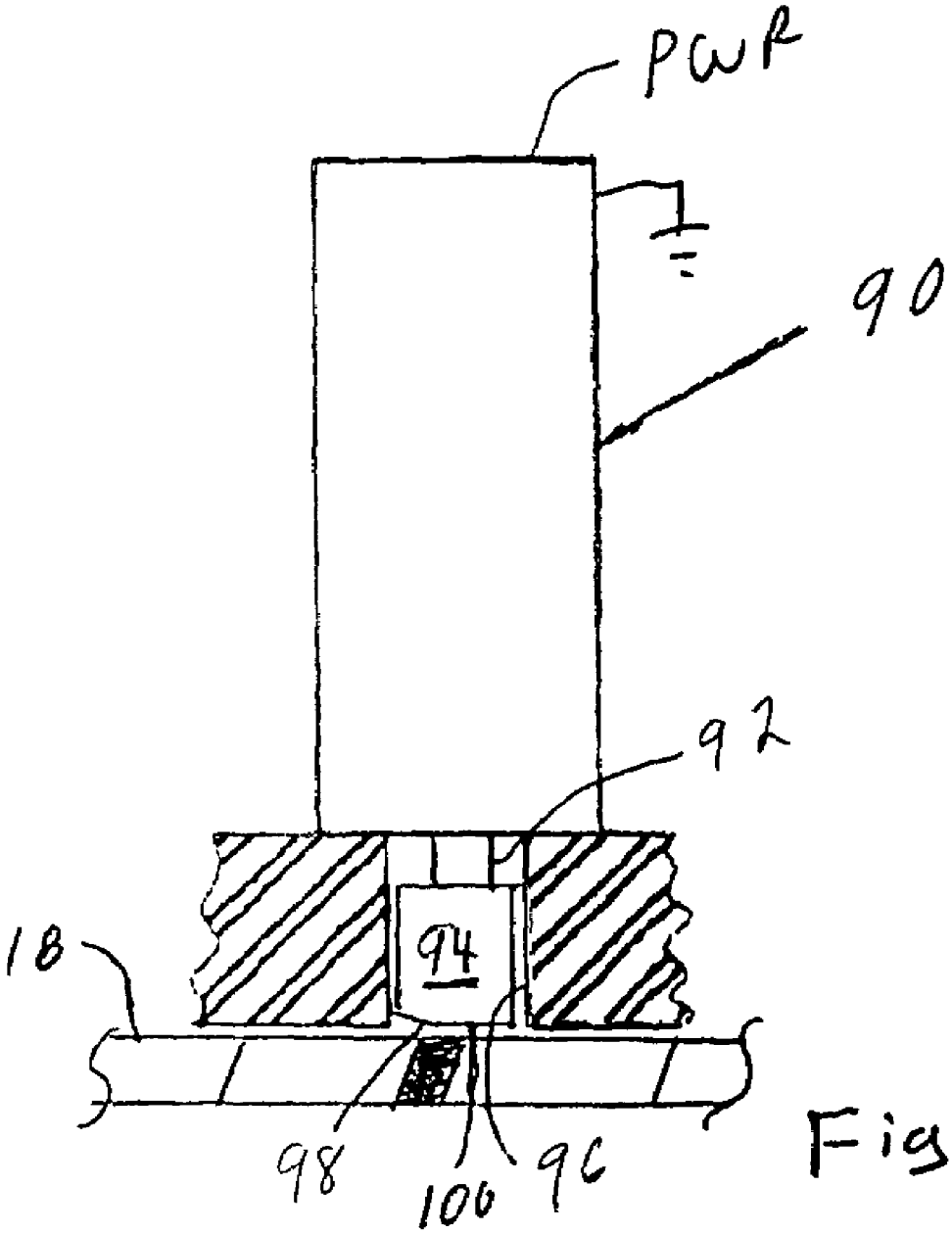
FIG. 9 is a view taken along line 9-9 of FIG. 4 showing placement of a solenoid arrangement for terminating coin flow.

For counting and terminating a flow of coins, reference is made to FIGS. 4 and 9, with FIG. 9 being a sectional view along lines 9-9 of FIG. 4. Here, a solenoid 90 is mounted to a top surface of plate 16, with a plunger 92 of solenoid 90 coupled to a cylindrical member 94 slidably fitted into an opening 96 of plate 16. Member 94 is provided with a bevelled edge 98 facing the flow of coins. Significantly, opening 96 is positioned in plate 16 as shown in FIG. 4 toward the beginning of the spiral of edge 34 so that when a flat lower portion 100 of member 94 is lowered to a level of the bottom surface of land portion 36 by solenoid 90, coins encountering the bevelled edge 98 no longer see the adjacent edge 34 and ride concentrically with the pad under the bottom surface of adjacent land portion 34 back into collection area 76. Concurrently with the solenoid lowering member 94, motor 64 is de-energized to allow the platter carrying pad 18 to coast to a stop, which allows coins already past cylindrical member 94 to be rotated out from under track 20 and strip 38.

For counting coins, a conventional coin counter 102 may be positioned generally as shown adjacent cylindrical member 94 so as to count all coins that move past member 94. Such coin counters are well known to those skilled in the art, and should require no further explanation.

An array of bag holders may be placed at intervals necessary for receiving sorted and separated coins along their respective trajectories as shown in FIG. 1 as the coins are propelled outward by the sorter. Significantly, the spread of coins from the coin sorter of the present invention is determined by dimensions of the discrete steps of strip 38. Here, shorter steps will result in a narrower spread of coins while longer steps will result in a wider spread of coins. As such, bag openings for more or fewer denominations of coins may be located in a given length of space. Further, due to the ability to configure the spread, the bags themselves may be located directly below the sorter without having any tubes leading from the openings to the bags. In this instance, a relatively narrow spread would allow the bag openings to be located close together, as shown in FIG. 1. Here, all the bag openings may be located within a 90 degree arc of plate 16.

As indicated above, the strip may be configured such that the smallest coin in the mixture of coins, in particular the dime for U.S. coinage, can be released along an exit path without coming into contact with the strip. For this purpose the first segment is spaced apart sufficiently from the indexing line so that dimes clear the first step without being captured by strip 38 and immediately pass above the strip as facilitated by bump B and proceed along their trajectory to the opening for a collection bag or receptacle. Alternately, the strip can be placed in a position such that the smallest coin as well as larger ones will be captured and temporarily restrained by the strip.

The strip for performing separation of the coins should be rigid and flat, except for the bend B as disclosed above. Spring steel having a thickness of 0.040 may be a preferred material. 4140 semi-hardened tool steel may also be used. The strip may have a generally rectangular shape, with a first end placed adjacent to the exit area of the plate so that a coin wide enough to avoid being immediately released will be passed under a forward edge near a corner of the strip. The strip has a forward side facing the center of the disc and, as stated, is made up of a series of slightly concave segments or steps, one for each denomination of coins in the coin mixture where each discrete denomination has its own unique diameter. Any particular denomination, and thus diameter, of coin is released from capture by the strip when it reaches a respective step for that denomination where the dimension between the step and indexing ridge 48 is greater than the diameter of the coin of that denomination. The segments are placed at varying distances from the indexing ridge 34, with the shortest distance used for the smallest coin and progressively larger distances used for coins of larger diameters. One configuration of the segments may be to align the forward edge of each segment to obtain an arcuate step edge centered on the center of the disc and defined by a common radius from the center. Each segment or step placed at a greater distance from the indexing line provides for releasing a larger coin by passage to an open area without restraint from an edge of the strip. For U.S. coinage mixtures the strip may have overall dimensions of 2 inches by 5.75 inches, and five segments, one for each denomination, except for the dime which may be small enough to bypass the first segment. The strip may also be provided with a bevelled edge in order to facilitate effective separation of the coins.

While the invention is described above in terms of specific embodiments, it is not to be understood as limited to these embodiments, but is limited only as indicated by the appended claims.

What is claimed is:

1. A coin sorter comprising:

a rotatable, resilient disc having a center;

a stationary, generally annular plate disposed above said disc, said plate having defined therein a central opening for receiving coins of mixed denominations to be sorted;

said plate having an upper side and an underside, said underside comprising a generally spiral, recessed track and an outwardly extending spiral land, said coins becoming captured between said track and said disc, indexed inwardly against said land and aligned in a single layer and a single file;

said track terminated at an exit area where said coins may move forward out from under said track, thereby being released by said track, wherein said exit area of said plate has an outer corner of a lower side of said exit area and a corner notch defined therein;

a separator strip having a first end located such that said coins may be intercepted and are captured by said strip as soon as they are released by said track, except for the smallest of the coins, which may alternately be separated without being captured by said strip;

said strip having a side edge including a series of segments, each said segment having a slightly concave shape facing said center and said segments differing from one another in that the segment nearest to said exit area of said track has the smallest size and the shortest distance to said center, and subsequent segments in the series have progressively larger sizes and longer distances to said center, each said segment corresponding in size with a coin denomination and said coins becoming released from capture upon being propelled past a said segment spaced farther apart from said land against which said coins are indexed than the diameter of the coin, each said coin upon release by said strip being projected outwardly along a specific predetermined path, and wherein said strip has a bent-up projection engaging said corner notch of said exit area;

receptacles placed for receiving the resulting separated coins; and means for rotating said disc.

2. The coin sorter defined in claim 1 wherein said projection is bent upward 0.020 to 0.030 inch over a distance of about 0.300 inch.

3. The coin sorter as defined in claim 1 wherein said exit area has a region adjacent said notch extending across a remainder of said exit area not occupied by said notch and said region has defined therein a downwardly extending bump, causing smaller coins to be tipped so as to provide a small elevation and clear said strip.

4. The coin sorter as defined in claim 3 wherein said bump extends downward about 0.002 to 0.004 inch.

5. The coin sorter as defined in claim 1 wherein each of said segments has an arcuate shape centered on said center of said disc and defined by a common radius from said center.

6. The coin sorter as defined in claim 5 wherein said strip comprises a flat and rigid spring steel strip having a thickness of 0.040 inch.

7. The coin sorter as defined in claim 5 wherein said strip is located at a level common with said exit area of said track.

8. The coin sorter as defined in claim 7 wherein said edge of said strip facing said center generally follows said indexing land, and an open space is defined between said edge and said land, providing release points for separated coins.

* * * * *